United States Patent [19]

Blain et al.

[11] Patent Number: 5,039,310

[45] Date of Patent: Aug. 13, 1991

[54] POLYETHER SUBSTITUTED MANNICH BASES AS FUEL AND LUBRICANT ASHLESS DISPERSANTS

[75] Inventors: David A. Blain, Morrisville, Pa.; Angeline B. Cardis, Florence, N.J.

[73] Assignee: Mobil Oil Corporation, New York, N.Y.

[21] Appl. No.: 280,457

[22] Filed: Dec. 6, 1988

[51] Int. Cl.[5] ..... C10L 1/22; C07C 211/00; C07C 215/00

[52] U.S. Cl. ..... 44/424; 44/425; 564/367; 564/370; 564/390

[58] Field of Search ..... 252/50, 51.5 A, 351, 252/355, 357; 44/72, 424, 425; 564/367, 370, 390

[56] References Cited

U.S. PATENT DOCUMENTS

| | | | |
|---|---|---|---|
| 3,309,182 | 3/1967 | Crowley et al. | 44/72 |
| 3,802,895 | 4/1974 | Dahlgren et al. | 564/367 |
| 3,877,889 | 4/1975 | Dix | 44/424 |
| 4,117,011 | 9/1978 | Malec | 564/367 |
| 4,144,034 | 3/1979 | Cummings | 44/71 |
| 4,186,102 | 1/1980 | Malec | 564/367 |
| 4,234,321 | 11/1980 | Lilburn | 44/72 |
| 4,261,704 | 4/1981 | Langdon | 44/62 |
| 4,485,048 | 11/1984 | Richmond et al. | 564/390 |
| 4,696,755 | 9/1987 | Campbell | 252/515 R |
| 4,720,350 | 1/1988 | Zoleski et al. | 252/51.5 A |
| 4,952,732 | 8/1990 | Speranza et al. | 564/390 |

FOREIGN PATENT DOCUMENTS

| | | |
|---|---|---|
| 1085857 | 10/1967 | United Kingdom . |

*Primary Examiner*—William R. Dixon, Jr.
*Assistant Examiner*—James M. Hunter, Jr.
*Attorney, Agent, or Firm*—Alexander J. McKillop; Charles J. Speciale; Howard M. Flournoy

[57] ABSTRACT

Reaction products in which polyethers are grown from substituted phenol-containing mannich bases have been found to be effective ashless dispersants and detergents for fuels and lubricants.

28 Claims, No Drawings

POLYETHER SUBSTITUTED MANNICH BASES AS FUEL AND LUBRICANT ASHLESS DISPERSANTS

BACKGROUND OF THE INVENTION

This application is directed to products derived from polyether modified phenol-containing Mannich bases which are highly useful as ashless dispersants when small amounts thereof are combined with hydrocarbon fuels, or lubricating oils. The invention accordingly relates to novel products and to the use of such products in lubricants or liquid fuels to improve the detergent characteristics thereof and to improve fuel consumption in internal combustion engines.

Those skilled in the art know that additives impart special properties to the lubricants and fuels to which they have been added. They may provide new properties or they may enhance properties already present. It is also well known that under the severe driving conditions with respect to operating temperatures of internal combustion engines and to weather conditions as well, sludge and other deposits form in the crankcase and in the oil passages of gasoline or diesel engines which severely limits the ability of the oil to lubricate the engine. Accordingly, there is a constant search and need for new and improved additives which will not only improve lubricity, but maintain cleanliness and disperse sludge formations.

Products containing both polyether and amine fragments are known as dispersants as disclosed in U.S. Pat. Nos. 4,234,321, 4,261,704 and 4,696,755. Unlike the instant invention the '755 patent describes growing polyether groups off saturated aliphatic alcohols and using the products as lubricant oil dispersants; the '704 patent describes preparing polyoxyalkylene polyamines by reacting a polyoxyalkylene polyol or glycol with a halogen containing compound; the '321 patent describes an additive produced by a hydrocarbylpoly (oxyalkylene) alcohol with phosgene and certain polyamines.

It is also well known in the art to employ nitrogen-containing dispersants and/or detergents to overcome or at least alleviate the above mentioned problems. U.S. Pat. No. 4,696,755 is directed to lubricating oils containing an additive useful for its dispersancy and detergency characteristics comprising hydroxy polyether amines. U.S. Pat. No. 4,144,034 disclose the use of a reaction product of a polyether amine and maleic anhydride as a carburetor detergent. U.S. Pat. No. 3,309,182 discloses polyether diamines as sludge inhibitors in petroleum distillate fuels. U.S. Pat. No. 4,717,492 is directed to the reaction products of Mannich bases with amines, thiols or dithiophosphoric acids.

It is now been found that polyether groups or polyoxyalkylene groups can be grown off the phenol portion of Mannich bases to provide dispersency characteristics for both lubricant and fuel compositions.

SUMMARY OF THE INVENTION

In accordance with the invention there is provided a lubricant or liquid fuel composition comprising a major proportion of a lubricant or fuel and a detergency/dispersency amount of an additive product derived by growing polyether groups off phenol-containing Mannich bases. The resultant product of reaction may generally be described as a polyether substituted Mannich base.

Mannich bases (made, for example, by reacting alkylated phenols, aldehydes and amines) are first reacted with an alkali metal or salt thereof such as potassium or a potassium salt. The resulting salt is then reacted with epoxides to make the polyether substituted Mannich bases which may include but are not limited to structures as generally described below:

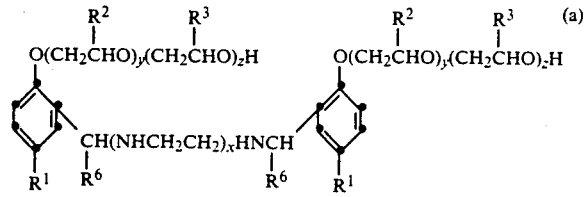

(a)

and

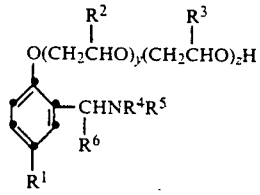

(b)

where x is 1 to about 6, y and z are 0 to about 50 and y+z equals 10 to about 100. $R^1$ is hydrogen or a $C_1$ to about a $C_{16}$ hydrocarbyl or aryl group, $R^2$ and $R^3$ are hydrogen or $C_1$ to about $C_6$ hydrocarbyl, $R^4$, $R^5$ and $R^6$ are hydrogen, $C_1$ to about $C_{30}$ hydrocarbyl or aryl or a nitrogen containing group.

The amine portion of the molecule may contain any primary or secondary amines and combinations thereof. For example, diethylene triamine, triethylene tetramine, tetraethylene pentamine, and pentaethylene hexamine and the corresponding propylene amines, and mixtures of the above.

Useful amines include but are not limited to amines such as N-oleyl diethylenetriamine, N-soya diethylenetriamine, N-coco diethylenetriamine, N-tallow diethylenetriamine, N-tetradecyl diethylenetriamine, N-octadecyl diethylenetriamine, N-eicosyl diethylenetriamine, N-triacontyl diethylenetriamine, N-oleyl dipropylenetriamine. N-soya dipropylenetriamine, N-coco dipropylenetriamine, N-tallow dipropylenetriamine, N-decyl dipropylene-triamine, N-dodecyl dipropylenetriamine, N-tetradecyl dipropylenetriamine, N-octadecyl dipropylenetriamine, N-eicosyl dipropylenetriamine, N-triacontyl dipropylenetriamine, the corresponding N-$C_{10}$ to $C_{30}$ hydrocarbyl dibutylenetriamine members as well as the corresponding mixed member as for example, the N-$C_{10}$ to $C_{30}$ hydrocarbyl ethylenepropylenetriamine, N-$C_{10}$ to $C_{30}$ hydrocarbyl ethylenebutylenetriamine and N-$C_{10}$ to $C_{30}$ hydrocarbyl propylenebutylenetriamine. Preferred are tetraethylene pentamine, triethylene tetramine and diethylene triamine.

Any suitable phenol or alkylated phenol may be used for example a $C_1$ to about a $C_{16}$ alkyl phenol such as nonyl phenol or dodecyl phenol.

Any suitable $C_2$ to about a $C_8$ alkylene oxide or mixtures thereof may be used in the instant process. Preferred are propylene oxide, butylene oxide, and mixtures thereof. Any suitable alkyl or aryl aldehyde may be used, preferred are $C_1$ to about $C_{30}$ or more alkyl or aryl aldehydes.

The Mannich base can be made by simply reacting a suitable alkylated phenol and a suitable amine with an aldehyde. The product thereof is then reacted with an alkali metal salt or directly with an alkali metal such as potassium or sodium at a temperature and for a time sufficient to form a salt which is then reacted with a suitable epoxide, or mixture of epoxides.

The general reaction conditions for making the Mannich base are not critical. Reaction between the phenol, the amine and the aldehyde can take place at temperatures varying from about 65° to about 130° C. for up to about 4 to 10 hours but where the specific reactants require it up to 24 hours may be used for the reaction completion. The molar ratio of the alkylphenol to amine to aldehyde may vary widely preferably from about 1.0:1.0:1.0 to about 3.0:1.0:3.5 and the molar rates of Mannich base to alkali metal or alkali metal salt is from about 1.0:0.8 to about 1.0:3.5. In the reaction to grow the polyethers off the Mannich base salt, molar ratios may also vary widely, preferably from about 1.0:10.0 to about 1.0:100.0 of Mannich base alkali metal salt to alkylene oxide.

Hydrocarbon solvents or other inert solvents may be used if so desired. In general, any hydrocarbon solvent can be used in which the reactants are soluble and which can, if the products are soluble therein, be easily removed. Such as benzene, toluene and xylenes.

An important feature of the invention is the ability of the additives to improve the detergency/dispersency qualities of oleaginous materials such as lubricating oils, which may be either a mineral oil, a synthetic oil, or mixtures thereof, or a grease in which any of the aforementioned oils are employed as a vehicle. The product of this invention can be added to a lubricant in amount of about 0.1% to 10% by weight of the total composition. In general, mineral oils, both paraffinic, naphthenic or mixtures thereof, may be employed as a lubricating oil or as the grease vehicle. The mineral oils may be of any suitable lubricating viscosity range, as for example, from abut 45 SSU at 100° F. to about 6000 SSU at 100° F., and preferably from about 50 to about 250 SSU at 210° F. These oils xay have viscosity indices ranging to about 100 or higher. Viscosity indices from about 70 to about 95 are preferred. The average molecular weights of these oils may range from about 250 to about 800. Where the lubricant is to be employed in the form of grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These xay include any of the conventional metal salts or soaps, which are dispersed in the lubricating vehicle in grease-forming quantities in an amount sufficient to impart to the resulting grease composition the desired consistency. Other thickening agents that may be employed in the grease formulation may comprise the non-soap thickeners, such as surface modified clays and silicas, aryl ureas, calcium complexes and similar materials. In general, grease thickeners xay be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils are desired, various classes of oils may be successfully utilized. Typical synthetic vehicles include polyisobutylenes, polybutenes, hydrogenated polydecenes, polypropylene glycol, polyethylene glycol, trixethylol propane esters, neopentyl and pentaerythritol esters, di(2-ethylhexyl)-sebacate, di(2-ethylhexyl)adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes (polysiloxanes) and silicones and alkyl-substituted diphenyl ethers typified by a butyl-substituted bis(p-phenoxy phenyl)ether, phenoxy phenylethers. In preparing greases using synthetic oils, any thickeners known to the art (including some of those mentioned hereinabove) can be used.

It is to be understood that the lubricant compositions contemplated herein can also contain other materials. For example, corrosion inhibitors, extreme pressure agents, viscosity index improvers, coantioxidants, antiwear agents and the like can be used. These include, but are not limited to, phenates, sulfonates, succinimides, zinc dialkyl dithiophosphates, and the like. These materials do not detract from the value of the compositions of this invention; rather the materials serve to impart their customary properties to the particular compositions in which they are incorporated.

The products of this invention can also be employed in liquid fuels such as hydrocarbon fuels, alcohol fuels or mixtures thereof, including mixtures of hydrocarbons, mixtures of alcohols and mixtures of hydrocarbon and alcohol fuels to reduce friction and improve fuel economy. About 25 pounds to about 500 pounds or preferably about 50 to 200 pounds, of additive per thousand barrels of fuel for internal combustion engines may be used. Liquid hydrocarbon fuels include gasoline, fuel oils, diesel oils and oxygenated fuels such as gasohol, alcohols and ethers and mixtures thereof. Methyl and ethyl alcohols are example of alcohol fuels. The additives in accordance herewith are particularly useful in unleaded fuels. Other additives such as octane boosters, friction modifiers, stabilizers, antirust agents, demulsifiers, metal deactivators, dyes and the like can be used with our detergent/dispersant additive in the fuel compositions.

In general, the reaction products of the present invention may be used in any amount which is effective for imparting the desired degree of detergency/dispersancy characteristics and resulting fuel economy improvements.

The following examples present illustrations of the invention. They are illustrative only and are not meant to limit the invention.

EXAMPLE 1

Nonylphenol, 440.8 grams (2.0 mol.), and 103.2 grams (1.0 mol.) of diethylene triamine were charged to a 1 liter reactor equipped with a $N_2$ inlet, mechanical stirrer, thermometer, and Dean Stark trap. The mixture was heated to 70° C. under a blanket of $N_2$. A total of 63.0 grams (2.1 mol.) of paraformaldehyde was added in four equal portions over 90 minutes. The mixture was heated to 110° C. for two hours. About 24 milliliters of water were collected in the Dean Stark trap. A further 12 milliliters of water were collected upon stripping the mixture under house vacuum (250–300 mm Hg) at 110° C. for two hours. The resulting viscous material was purified by hot filtration through celite. Nitrogen analysis: 6.8%

EXAMPLE 2

The procedure of Example 1 is followed to prepare the Mannich base with the following exception: 189 grams (1.0 mol.) of tetraethylene pentamine is substituted for diethylene triamine. Nitrogen analysis: 7.9%

EXAMPLE 3

The procedure of Example 1 is followed to prepared the Mannich base with the following exception: 524 grams (2.0 mol.) of dodecyl phenol is substituted for nonylphenol. Nitrogen analysis: 5.6%

EXAMPLE 4

56.8 grams (0.1 mol.) of the product from Example 1 and 200 milliliter of toluene were charged to a one liter reactor equipped with a $N_2$ inlet, mechanical stirrer, thermometer, and Dean Stark trap. The solution was refluxed for 16 hours. It was then cooled to room temperature and 7.4 grams (0.19 mol.) K metal were added, causing the evolution of $H_2$. The reaction was heated to 50° C. for 24 hours under a $N_2$ purge, at wich time no K was evident. The toluene was distilled off through the Dean Stark trap until a pot temperature of 150° C. was reached. The reaction was cooled to about 90° C., the Dean Stark trap was replaced with a condenser, and an addition funnel charged with 288.4 grams (4.0 mol.) of butylene oxide which was added over three hours, keeping the reaction temperature above 85° C. When the refluxing ceased, the reaction was transferred to a separatory funnel with 150 milliliters n-butanol and was washed with 3×100 milliliter portions of water. The butanol was removed via rotary evaporation and the resulting product was filtered through celite. The product was analyzed by IR and NMR ($^1H$ and $^{13}C$) Spectra were consistent with the proposed product composition. Nitrogen analysis: 1.1%

EXAMPLE 5

The procedure from Example 4 is followed to prepare the polyether substitued Mannich base with the following exception: one half the amount of butylene oxide is used. Nitrogen analysis: 1.9%

EXAMPLE 6

56.8 grams (0.1 mol.) of the product from Example 1 and 200 milliliters of toluene were charged to a one liter reactor equipped with $N_2$ inlet, mechanical stirrer, thermometer, and Dean Stark trap. The solution was refluxed for 16 hours and cooled to room temperature. 21.3 grams (0.19 mol.) potassium t-butoxide was added and the mixture was heated at 75° C. for two hours. The Dean Stark trap was replaced with a distillation head and the toluene and t-butyl alcohol were stripped under house vacuum (250–300 mm Hg) at a temperature of up to about 100° C. The distillation head was replaced with a condenser and an addition funnel charged with 288.4 grams (4.0 mol.) butylene oxide was attached to the reactor. The butylene oxide addition and workup were as described in Example 4. Nitrogen analysis: 1.1%

EXAMPLE 7

23.0 grams (0.04 mol.) of the product from Example 1, 4.8 grams 88% KOH (0.075 mol.), and 125 milliliter of toluene were charged to a 500 milliliter reactor equipped with a $N_2$ inlet, mechanical stirrer, thermometer, and Dean Stark trap. The solution was refluxed for four hours, during which time about 1.6 milliliters of water were collected. The toluene was then distilled off through the Dean Stark trap up to 110° C. The Dean Stark trap was replaced with a distillation head and the remaining toluene and water were stripped under house vacuum (250–300 mm Hg) up to a temperature of 100° C. The distillation head was replaced with a condenser and an addition funnel charged with 115.4 grams (1.6 mol.) butylene oxide was attached to the reactor. The butylene oxide addition and workup were done as described in Example 4. Nitrogen Analysis: 1.1%

EXAMPLE 8

The procedure from Example 7 is followed to prepare the polyether substituted Mannich base with the following exception: the Mannich base from Example 2 is substituted for the Mannich base from Example 1. Nitrogen Analysis: 2.0%

EXAMPLE 9

The procedure from Example 7 is followed to prepare the polyether substituted Mannich base with the following exception: the Mannich base from Example 3 is substituted for the Mannich base from Example 1. Nitrogen Analysis: 1.1%

EXAMPLE 10

The procedure from Example 7 is followed to prepare the polyether substituted Mannich base with the following exception: 0.92 mol. propylene oxide is substituted for the 1.6 mol. butylene oxide. Nitrogen Analysis: 1.7%

EXAMPLE 11

The procedure from Example 7 is followed to prepare the polyether substituted Mannich base with the following exception: 3.0 mol. propylene oxide is substituted for the 1.6 mol. butylene oxide. Nitrogen Analysis: 0.8%

EVALUATION OF THE COMPOUNDS

Selected products of the action in accordance with the invention were evaluated by the CRC Carburetor Cleanliness Test in Philips J Unleaded Fuel, using the procedure outlined in (Coordinating Research Council) CRC Report No. 529.

The results of the tests can be found in the table which shows the percent of clean-up accomplished by the selected examples.

TABLE

| Additive | Dosage (lb/MB) | Depost wt (mg) | % Cleanup |
|---|---|---|---|
| Base | — | 17 | |
| Example 4 | 80 | 9 | 47.1 |
| Base | — | 24 | |
| Example 5 | 75 | 4 | 83.3 |
| Base | — | 19 | |
| Example 6 | 100 | 6 | 68.4 |

The above results clearly demonstrate that additive compounds in accordance herewith provide excellent detergent/dispersency characteristics to fuel compositions.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

We claim:

1. A product of reaction comprising (1) reacting phenol or a $C_1$ to about a $C_{16}$ alkylphenol with a primary or secondary amine and a $C_1$ to about a $C_{30}$ aldehyde and thereafter (2) reacting the resultant intermediate product of (1) with an alkali metal or alkali metal salt to form a Mannich base alkali metal salt and thereafter the product of (2) is then (3) reacted with a $C_2$ to about a $C_3$ alkylene epoxide or mixtures thereof to make a polyether substituted Mannich base having the structures generally described below:

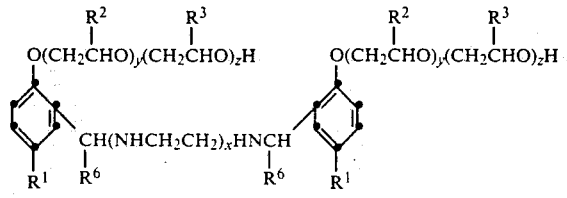

or

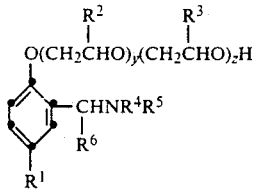

where x is 1 to about 6, y and z are 0 to about 50 and y+z equals 10 to about 100; $R^1$ is hydrogen or a $C_1$ to about a $C_{16}$ hydrocarbyl or aryl group; $R^2$and $R^3$ are independently hydrogen or $C_1$ to about $C_6$ hydrocarbyl; $R^4$, $R^5$ and $R^6$ are independently hydrogen, $C_1$ to $C_{30}$ hydrocarbyl or aryl or a nitrogen containing hydrocarbyl group.

2. The product of claim 1 where the molar ratio of the alkylphenol to amine to aldehyde varies from about 1.0:1.0:1.0 to about 3.0:1.0:3.5.

3. The product of claim 1 where the mole ratio of the Mannich base to the alkali metal or alkali metal salt is from about 1.0:0.8 to about 1.0:3.5.

4. The product of claim 1 wherein said alkyl phenol is nonyl phenol.

5. The product of claim 1 wherein said alkyl phenol is dodecycl phenol.

6. The product of claim 1 wherein said aldehyde is selected from formaldehyde or paraformaldehyde.

7. The product of claim 1 wherein said epoxide is butylene oxide.

8. The product of claim 1 wherein said epoxide is propylene oxide.

9. The product of claim 1 wherein said epoxide is a mixture of propylene oxide and butylene oxide.

10. The product of claim 1 wherein said alkali metal is sodium or posassium and said alkali metal salt is a salt thereof.

11. The product of claim 10 wherein said alkali metal is potassium hydroxide and said alkali metal salt is a salt thereof.

12. The product of claim 1 wherein said amine is selected from the group consisting of diethylene triamine, triethylene tetramine, tetraethylene pentamine, and pentaethylene hexamine and the corresponding propylene amines.

13. The product of claim 12 wherein said amine is diethylene triamine.

14. The product of claim 12 wherein said amine is triethylene tetramine.

15. The product of claim 12 wherein said amine is tetraethylene pentamine.

16. A composition comprising a major proportion of a liquid fuel and a minor detergent/dispersant amount of the product of reaction comprising (1) reacting phenol or a $C_1$ to about a $C_{16}$ alkylphenol with a primary or secondary amine and a $C_1$ to about a $C_{30}$ aldehyde and thereafter (2) reacting the resultant intermediate product of (1) with an alkali metal or alkali metal salt to form a Mannich base alkali metal salt and thereafter the product of (2) is then (3) reacted with a $C_2$ to about a $C_8$ alkylene epoxide or mixtures thereof to make a polyether substituted Mannich base having one or more of the structures as generally described below:

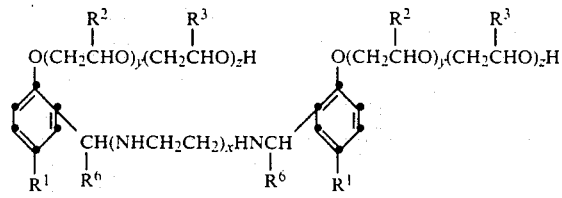

and

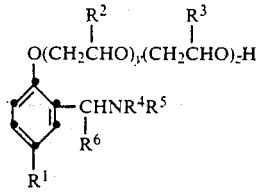

where x is 1 to about 6, y and z are 0 to about 50 and y+z equals 10 to 100, $R^1$ is hydrogen or $C_1$ to about $C_{16}$ hydrocarbyl or aryl group, $R^2$ and $R^3$ are independently hydrogen or $C_1$ to about $C_5$ hydrocarbyl, $R^4$, $R^5$ and $R^6$ are independently hydrogen, $C_1$ to $C_{30}$ hydrocarbyl or aryl or a nitrogen containing hydrocarbyl group.

17. The composition of claim 16 wherein the alkyl phenol is selected from nonyl phenol and dodecyl phenol.

18. The composition of claim 16 wherein the aldehyde is selected from formaldehyde and paraformalderhyde.

19. The composition of claim 16 wherein the alkylene epoxide is selected from butylene oxide, proxylene oxide and mixtures thereof.

20. The composition of claim 16 wherein the amine is selected from the group consisting of diethylenetriamine, triethylenetetramine, tetraethylene pentamine, and pentaethylene hexamine and the corresponding propylene amines.

21. The composition of claim 16 wherein the alkali metal or alkali metal salt thereof is sodium or potassium or a salt thereof.

22. The composition of claim 21 wherein said alkali metal is potassium hydroxide and said alkali metal salt is a salt thereof.

23. The composition of claim 16 wherein said. major proportion is a liquid hydrocarbon fuel.

24. The composition of claim 16 wherein said fuel is a gasoline or an oxygenated fuel.

25. The composition of claim 24 wherein said oxygenated fuel is selected from gasohol, alcohols, ethers or mixtures thereof.

26. The composition of claim 24 wherein said gasoline is an unleaded gasoline.

27. The composition of claim 16 having from about 25 to about 500 lbs of said reaction product per 1000 bbs of fuel.

28. The composition of claim 27 having about 50 to about 200 lbs of said reaction product per 1000 bbs of fuel.

* * * * *

UNITED STATES PATENT AND TRADEMARK OFFICE

CERTIFICATE OF CORRECTION

PATENT NO. : 5,039,310

DATED : August 13, 1991

INVENTOR(S) : David A. Blain et al.

It is certified that error appears in the above-identified patent and that said Letters Patent is hereby corrected as shown below:

column 7, line 11 reads "$C_2$ to about a $C_3$" should read --$C_2$ to about a $C_8$--.

Signed and Sealed this

Twentieth Day of April, 1993

*Attest:*

MICHAEL K. KIRK

*Attesting Officer*

*Acting Commissioner of Patents and Trademarks*